United States Patent [19]

Stinebaugh

[11] Patent Number: 4,553,508

[45] Date of Patent: Nov. 19, 1985

[54] INTERNAL COMBUSTION ENGINE

[76] Inventor: Donald E. Stinebaugh, 2320 N. Corbin Rd., Post Falls, Id. 83854

[21] Appl. No.: 456,036

[22] PCT Filed: Apr. 22, 1982

[86] PCT No.: PCT/US82/00507

§ 371 Date: Dec. 20, 1982

§ 102(e) Date: Dec. 20, 1982

[87] PCT Pub. No.: WO82/03889

PCT Pub. Date: Nov. 11, 1982

Related U.S. Application Data

[63] Continuation-in-part of Ser. No. 257,967, Apr. 27, 1981, abandoned.

[51] Int. Cl.[4] ..... F02B 75/26

[52] U.S. Cl. ..... 123/58 AA; 123/78 F; 123/332

[58] Field of Search ..... 123/307, 58 R, 58 A, 123/58 AA, 58 AM, 332, 78 R, 78 E, 78 F, 48 R, 48 B

[56] References Cited

U.S. PATENT DOCUMENTS

| | | | |
|---|---|---|---|
| 1,666,539 | 4/1928 | Michell | 123/58 AA |
| 1,788,140 | 1/1931 | Woolson | 123/58 AM |
| 2,237,621 | 5/1941 | Herrmann | 123/58 AB |
| 2,237,989 | 5/1941 | Herrmann | 123/58 AB |
| 2,243,817 | 5/1941 | Herrmann | 123/58 AB |
| 2,243,818 | 5/1941 | Herrmann | 123/41.31 |
| 2,243,819 | 5/1941 | Herrmann | 123/196 R |
| 2,243,820 | 5/1941 | Herrmann | 123/58 AB |
| 2,243,821 | 5/1941 | Herrmann | 123/58 AB |
| 2,243,822 | 5/1941 | Herrmann | 123/58 AB |
| 2,284,319 | 5/1942 | Herrmann | 409/123 |
| 2,957,463 | 10/1960 | Schnabel | 123/332 |
| 2,966,899 | 1/1961 | Herrmann | 123/58 AM |
| 2,983,264 | 5/1961 | Herrmann | 123/58 BB |
| 3,016,110 | 1/1962 | Herrmann | 184/6.17 |
| 3,598,094 | 8/1971 | Odawara | 123/58 A |
| 4,022,167 | 5/1977 | Kristiansen | 123/43 AA |
| 4,090,478 | 5/1978 | Trimble et al. | 123/58 R |
| 4,149,498 | 4/1979 | Ferrell | 123/58 AA |
| 4,157,079 | 6/1979 | Kristiansen | 123/43 AA |
| 4,294,139 | 10/1981 | Bex et al. | 123/58 B |

FOREIGN PATENT DOCUMENTS

| | | | |
|---|---|---|---|
| 2926489 | 1/1981 | Fed. Rep. of Germany | 123/307 |

OTHER PUBLICATIONS

Hall; "More Power From Less Engine"; SAE Journal (Transactions), vol. 47, No. 6; Dec. 1940; pp. 504–519.

"Transportation Pistons Times Two"; Popular Mechanics; Jan. 1982; p. 149.

Palmer et al; "The Dyna-Cam Engine"; Sport Aviation; Sep. 1981; pp. 41, 42 and 84.

*Primary Examiner*—Craig R. Feinberg

*Attorney, Agent, or Firm*—John P. Dellett

[57] ABSTRACT

An internal combustion engine comprises a plurality of cylinders disposed in circular array, each having a piston slidably received therewithin to define a combustion chamber. Connecting rods affixed to the pistons are provided with cam follower means for engaging a cam surface on a drum disposed coaxially with the aforementioned array, the cam follower means engaging different portions of the cam surface for causing the drum to rotate as the pistons fire. The drum is axially movable with respect to the array of pistons whereby the compression ratio of the engine is readily changed. Supercharging chambers are defined on opposite sides of said pistons from the combustion chambers for compressing a fuel-air mixture which may then be received into pressure tanks associated with the respective cylinders for delivery to the combustion chambers. The piston ends have helical surfaces for producing a swirling of gases within the combustion chambers.

4 Claims, 32 Drawing Figures

FIG. 4
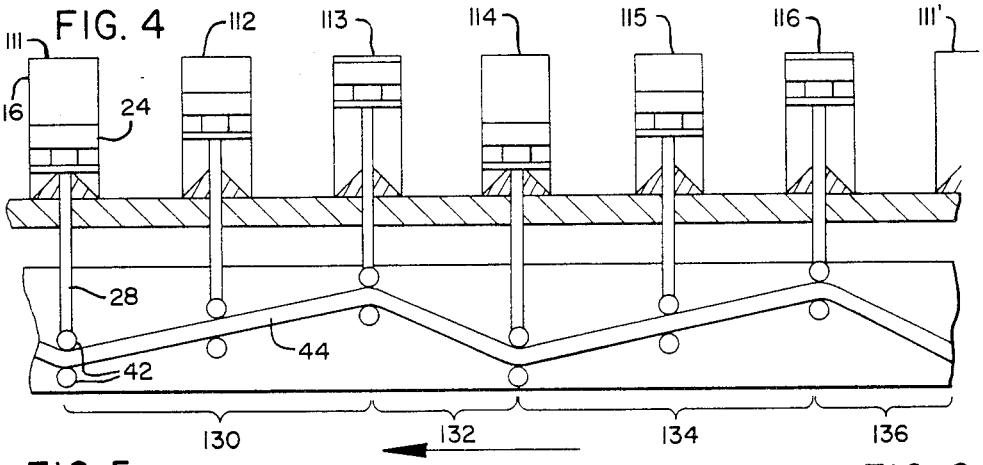
FIG. 5
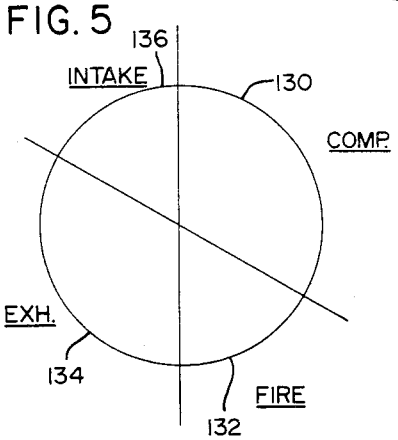
FIG. 6
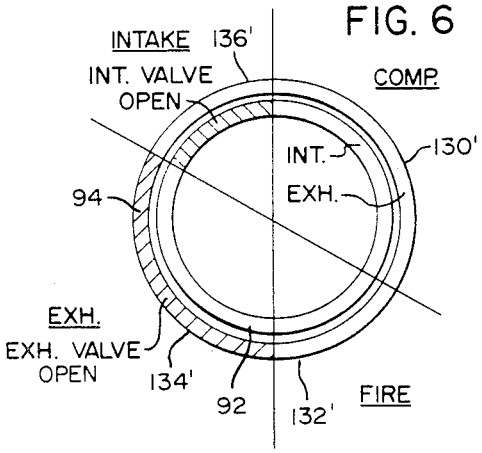
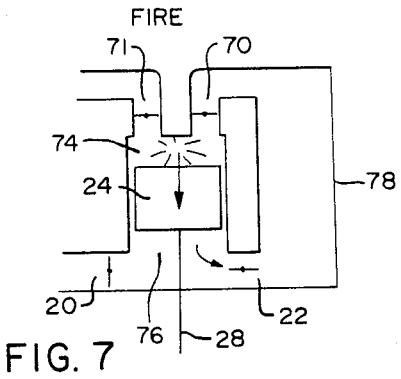
FIG. 7
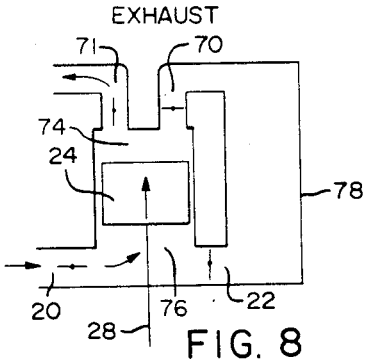
FIG. 8

FIG. 13
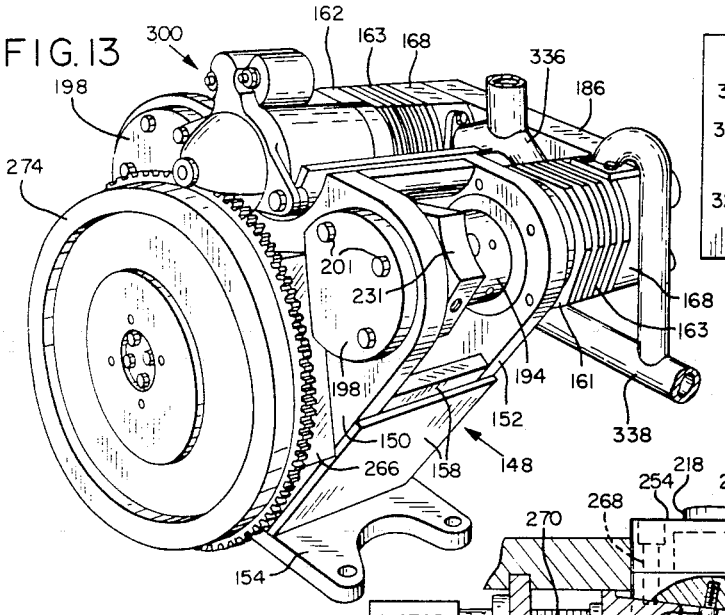
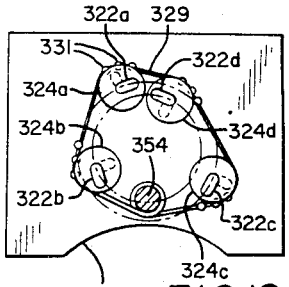
FIG. 19
FIG. 17
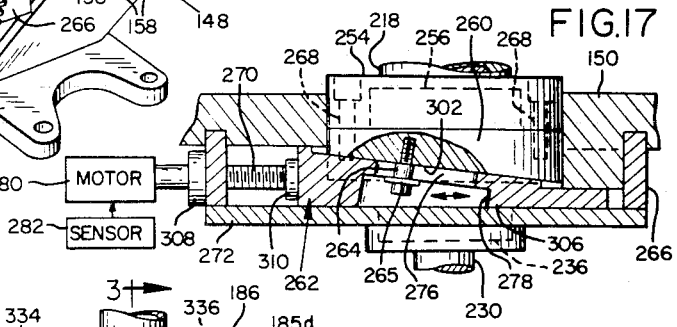
FIG. 14
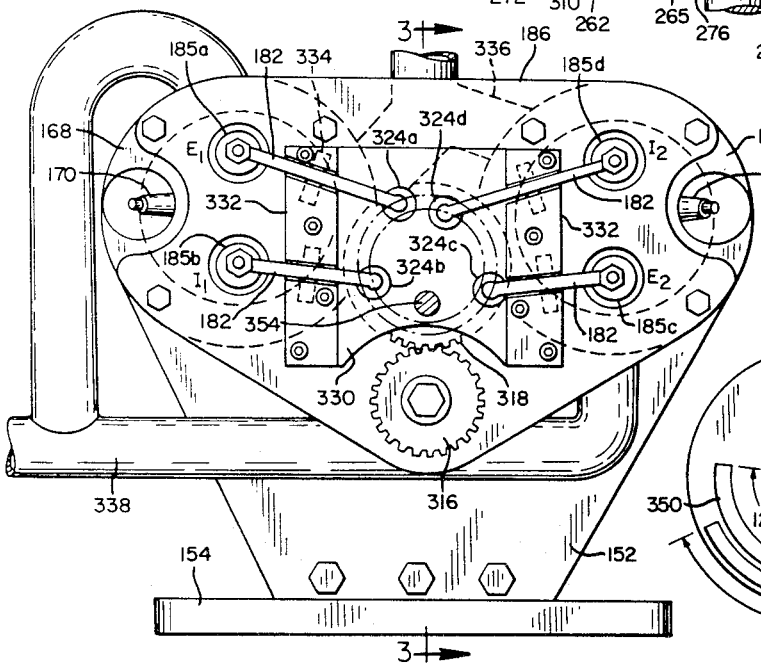
FIG. 18
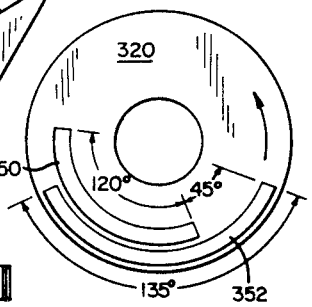

NO. 162 FIRES 0°
90°
180°
270°
NO. 161 FIRES 270°
360°
450°
540°
630°
NO. 162 FIRES 720°
270°
450°

90°
45°
90°
E1
E2
I1
I2

INTERNAL COMBUSTION ENGINE

This application is a continuation-in-part of application Ser. No. 257,967, filed on Apr. 27, 1981, now abandoned.

DESCRIPTION

Technical Field

The present invention relates to internal combustion engines and particularly to an internal combustion engine the compression ratio of which can be changed during operation.

Most internal combustion engines operate inefficiently over a portion of their speed range because of incomplete combustion. Thus, combustion may fail to take place all the way to the peripheral walls of the cylinder or all the way to the bottom of the stroke. Not only does efficiency suffer, but also objectionable unburned or partially burned products of the combustion process are emitted. Altering the engine compression ratio at various speeds in a manner such that more constant combustion takes place at the various speeds would be of advantage. However, difficult practical problems have been encountered heretofore in changing the compression ratio of an operating engine.

DISCLOSURE OF INVENTION

In accordance with the present invention in a principal embodiment thereof, a plurality of cylinders each receive a piston therewithin to define a combustion chamber and each cylinder combustion chamber is provided with means for selectively communicating a fuel-air mixture thereto and for communicating exhaust gases therefrom. A plurality of connecting rods, one extending from each of said pistons, are provided with cam followers and each engages a rotating cam means such that upon respective power strokes the cam followers bear against the cam means and rotate the same for delivering output power. According to a feature of the present invention, the cam means and the cam followers are relatively moveable toward and away from the cylinders to vary the compression ratio of the engine.

In accordance with another feature of the present invention, supercharging chambers are defined by said cylinders on the opposite sides of said pistons from the combustion chambers. A fuel-air mixture is compressed by the supercharging chambers and delivered to the combustion chambers.

In accordance with another feature of the present invention, the respective pistons are each provided with a helical end surface for producing a swirling action with respect to gases within the corresponding combustion chambers.

It is accordingly an object of the present invention to provide an improved and more efficient internal combustion engine.

It is a further object of the present invention to provide an improved internal combustion engine which emits a decreased proportion of unburned or partially burned products of the combustion process.

It is another object of the present invention to provide an improved internal combustion engine, the compression ratio of which may be readily altered.

It is another object of the present invention to provide an improved internal combustion engine having an improved horsepower-to-weight ratio.

Also in accordance with a feature of the new engine, an adjustable follower for a valve operating cam can bring about an adjustable valve opening period. Thus the relative time the intake valve is opened can be increased with increased engine speed so as to provide a more adequate fuel-air mixture intake to compress.

As an additional feature, an intake device may be employed to substantially shut off the supply from the carburetor to the engine when decelerating. At that time, an alternate passage provides increased air as an intake to the engine such that objectionable emissions are reduced.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

BRIEF DESCRIPTION OF DRAWINGS

FIG. 3 is a side view of an alternative splined connection employed with the FIG. 1 engine;

FIG. 4 is a diagram of a profile for a cam employed in the FIG. 1 engine;

FIG. 5 is a further diagrammatic representation of said cam;

FIG. 6 is a representation of cam tracks for operating intake and exhaust valves of the FIG. 1 engine;

FIGS. 7 through 10 are diagrammatic representations of firing, exhaust, intake and compression strokes for the FIG. 1 engine;

FIG. 13 is a perspective view of an internal combustion engine according to a second embodiment of the present invention;

FIG. 14 is a rear end view of the FIG. 13 engine;

FIG. 17 is a cross-sectional view, partly broken away, illustrating mechanism according to the FIG. 13 engine for changing the engine compression ratio;

FIG. 18 is a plan view of a cam plate employed in the FIG. 13 engine;

FIG. 19 is a detailed view of cam adjusting mechanism employed with the FIG. 13 engine;

BEST MODE FOR CARRYING OUT THE INVENTION

Figure 1:
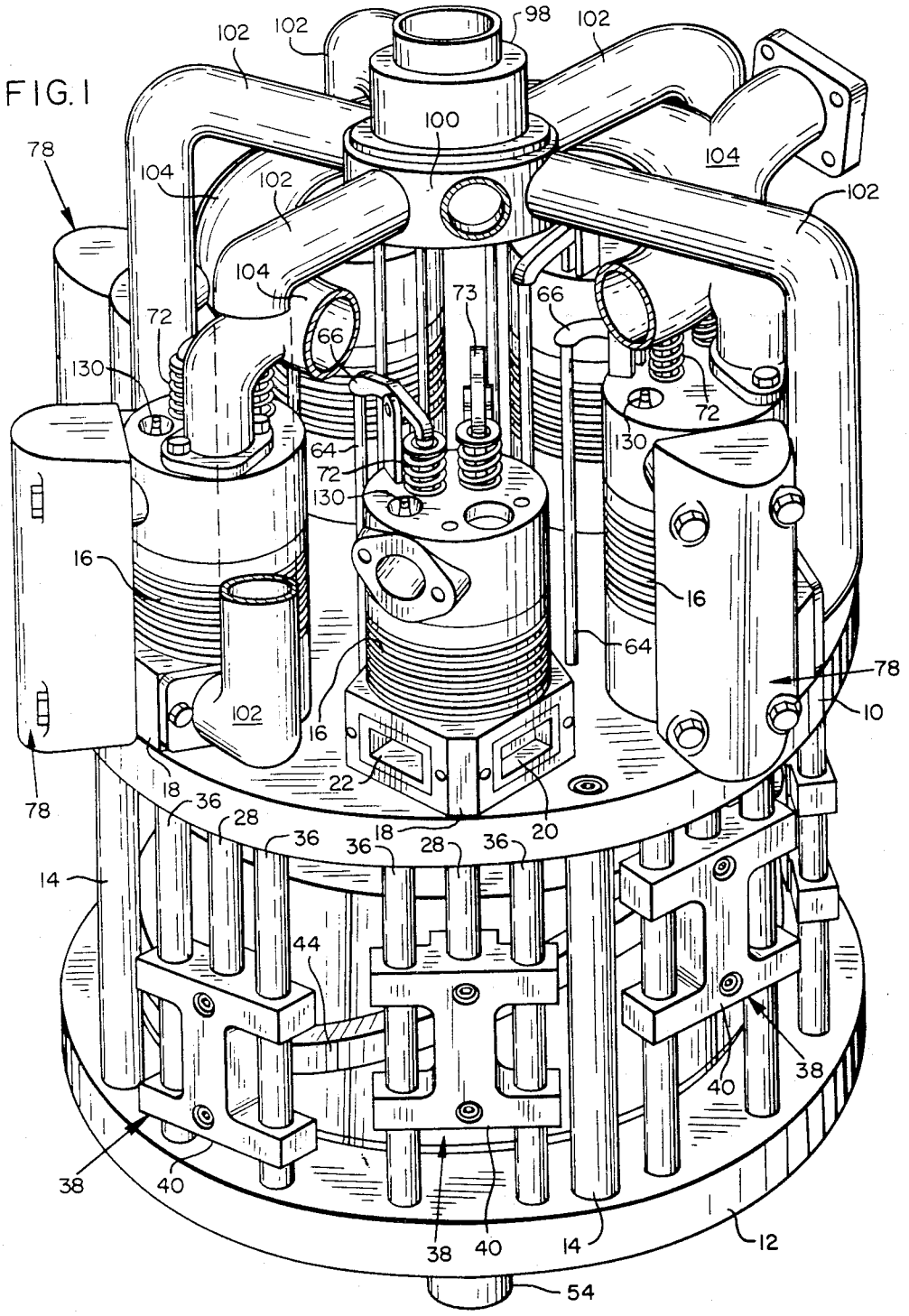
FIG. 1 is a perspective view of an internal combustion engine according to a first embodiment of the present invention with portions broken away for the purpose of illustrating component elements.

An engine according to an embodiment of the present invention will be described with reference to FIGS. 1 and 2. An engine frame comprises an upper circular plate 10 and a lower circular plate 12 spaced in substantially parallel relation by intermediate posts 14. Supported upon plate 10 is a circular array of cylinders 16, six in this embodiment, each provided with exterior cooling fins and integrally formed to include a lower valve housing 18. The valve housings receive reed valves at 20 and 22, the function of which will be hereinafter more fully discussed.

Each cylinder slidably receives a piston 24 provided with piston rings for sealing along the interior sleeve of the cylinder (not shown). The pistons are suitably necked down at 26 for the purpose of minimizing weight as well as for enhancing cooling and lubrication. Each piston is secured to a connecting rod 28 extending downwardly through plate 10 and a conical bushing 30 received in a circular well 32 in plate 10 whereby the bushing closes the bottom of the cylinder. The bushing 30 is provided with a sleeve 34 for slidably receiving rod 28 in sealing relation to define a supercharging chamber thereabove.

The lower end of each connecting rod 28 is secured to a cam follower assembly 38 comprising a slide block 40 which moves in a vertical direction on rods 36 disposed between plates 10 and 12 and parallel to the connecting rod 28. Mounted on slide block 40 is a pair of rollers 42 which respectively engage the upper and lower surfaces of a cam 44, the latter comprising a ridge generally rectangular in cross section and extending outwardly from cam drum 46. Cam drum 46 is comprised of an outer cylindrical portion 50 integral with the cam 44, and an inner drum portion 48 having a splined connection 52 with the cylindrical portion 50. The drum portion 48 is mounted on shaft 54 which is coaxial with the array of cylinders and which is rotatable with respect to plates 10 and 12 in bearings 56 and 96. Shaft 54 is ultimately driven by the pistons so as to provide a power delivery shaft of the engine.

A profile for cam 44 is illustrated in FIG. 4, this figure also showing the positions of pistons 24 located in cylinders 16. The successive positions for successive pistons are designated at 111 through 116 in FIG. 4, these positions being controlled by means of cam 44 which will be understood to rotate in a clockwise direction, i.e. from right to left as illustrated in FIG. 4. Successive segments 130, 132, 134 and 136 of cam 44 together comprise the complete three hundred sixty degree extent of the cam 44. The six pistons and cylinders employed according to the illustrated embodiment are equally spaced around the engine whereby their connecting rods 28, extending vertically downward from cylinders 16, are disposed at sixty degree intervals. Portion 130 of the cam may comprise a one hundred twenty degree segment thereof, portion 132 of the cam may comprise a sixty degree segment thereof, portion 134 of the cam may comprise a one hundred twenty degree segment thereof and portion 136 may comprise a sixty degree segment thereof. As can be seen from FIG. 4, as the cam rotates in a clockwise direction, the piston in a given cylinder, such as shown at 111, will move upwardly as cam portion 130 passes between rollers 42 since portion 130 of the cam is inclined upwardly and to the right. As the cam continues to rotate, portion 132 thereof, which is inclined downwardly to the right, will pass through rollers 42 and the piston will move downwardly to its original level. Since cam portion 132 in this particular embodiment has a shorter horizontal extent than cam portion 130, the piston will move downwardly more rapidly than it was moved upwardly. Further rotation of the cam will cause the same cam follower rollers 42 to encounter cam portion 134 which will again dictate upward movement of the piston for the one hundred twenty degree segment, ending at the level reached at the end of segment 130. Thereafter, cam portion 136 will pass through the same cam follower rollers and the piston under discussion will move downwardly once more during the next sixty degree segment of rotation of the cam to its original position. It will be noted that cam 44 will have a variable width to accommodate the constant spacing of rollers 42. For example, segments 132 and 136, disposed at a greater angle, will be thinner than segments 130 and 134. The cam is constructed to have a constant vertical spacing between upper and lower sides, and to have a smooth change in angular direction between segments.

The operation of the engine will be further discussed with the aid of the diagram of FIG. 5 wherein the circle is representative of cam 44 and segments or portions 130, 132, 134 and 136 respectively bring about the compression, firing, exhaust and intake strokes of a given piston of the four-stroke engine. In such case the cam would be viewed from underneath. Alternatively, FIG. 5 may be viewed as a diagram of successive phases of a four-stroke cycle, proceeding clockwise therearound. It will be seen the firing and input strokes in this embodiment are more rapid than the compression and exhaust strokes inasmuch as the downward movement of the connecting rod takes place during only sixty degrees of the total revolution of the cam, while upward movement of the connecting rod takes place each time over one hundred twenty degrees. During the firing stroke, a connecting rod urges the slide block 40 downwardly, with a roller 42 bearing against the top of cam 44 and providing a component of force to the left in FIG. 4 for rotating the cam in a clockwise direction. Since the angle of cam segment 132 with the horizontal is steeper than the angle of cam segment 130 with the horizontal, it is seen a greater component of force to the left can result than if all cam segments were of equal length or if cam segment 132 were longer. However, it is possible for the segments to be of equal length or have another ratio. In FIG. 4, the piston at position 113 is about to commence the firing stroke along the steeper cam segment 132, while the piston at 114 has just finished the firing stroke. After firing, a piston is exhausted by long cam section 134 after which intake segment 136 causes the piston to draw a new charge into the cylinder. Longer compression segment 130 then brings about upward movement of a piston for compressing the fuel-air mixture prior to firing. It will be noted each slide block 40 slides along rods 36 secured between plates 10 and 12, and therefore stress is relieved from connecting rods 28.

For the purpose of initiating combustion of the fuel-air mixture in a cylinder near the start of the firing stroke, conventional ignition and timing means (not shown) are provided. Also, appropriate valving is included for supplying the fuel-air mixture to each cylinder during intake and for scavenging spent gases during the exhaust stroke as hereinafter described.

In the illustrated example, the pistons at positions 111 through 116 are fired in order, i.e. successively around a circle, after which the cycle is repeated. However, it is readily apparent that valving and timing means may be employed for firing pistons on opposite sides of the engine at the same time, such as the pistons in positions 111 and 114. The drum 46 functions as a flywheel for delivering smooth rotational power to shaft 54 as the succesive pistons fire and cause assemblies 38 to bear downwardly against cam 44.

Figure 2:
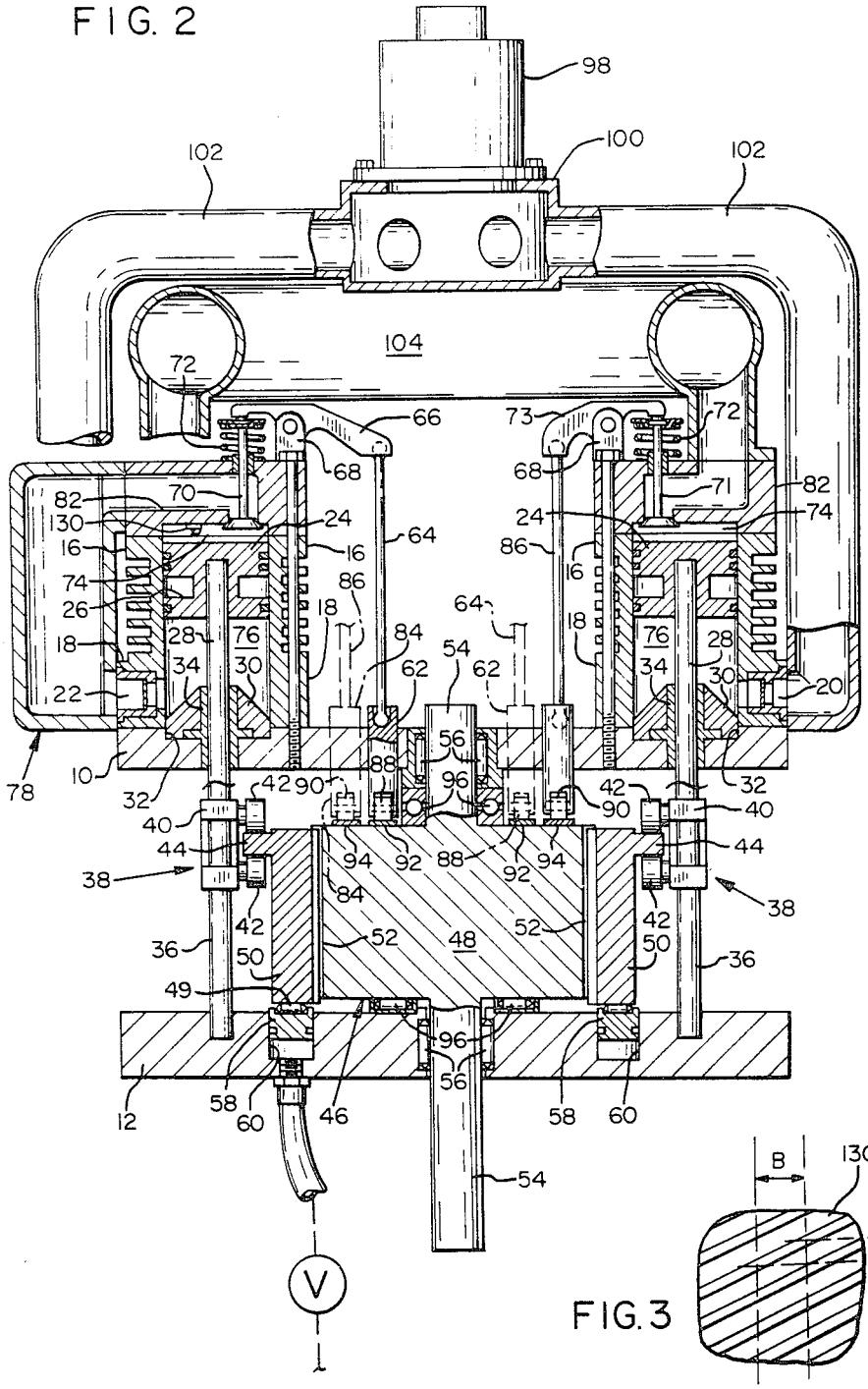
FIG. 2 is a vertical cross section of the FIG. 1 engine and also having portions broken away and shown in phantom for clarity of explanation.

Considering more particularly the intake and exhaust systems as illustrated in FIGS. 1 and 2, the top of drum 48 is provided with cam tracks 92 and 94 for respectively operating the intake and exhaust valves. Cam followers 62 and 84 extend downwardly through apertures in plate 10 and are provided with rollers 88 and 90 for bearing against the cam tracks. The cam followers operate push rods 64 and 86 which operate the valves, for example push rod 64 disposed between cam follower 62 and rocker arm 66 supported by pivot member 68 operates intake valve 70 for passing fuel-air mixture into combustion chamber 74 at the top of a cylinder. Valve 70 is normally held closed through action of spring 72 but is opened when the roller 88 of cam follower 62 encounters a raised portion of cam track 92 corresponding to the intake part of the cycle. Cam follower 84 is similarly raised for opening the exhaust valve 71 via push rod 86 and rocker arm 73 when follower 84 encounters the high part of cam track 94 during the exhaust stroke of a given piston. The cam tracks 92 and 94 are illustrated diagrammatically in FIG. 6 (inverted to correspond to the FIG. 5 diagram) wherein the raised parts of the cam tracks are shaded. In FIG. 6, the cam tracks are illustrated for the successive compression, firing, exhaust and intake portions of the cycle as illustrated at 130', 132', 134' and 136'.

Returning to FIGS. 1 and 2, a fuel-air mixture provided via intake manifold 100 from conventional carburetor 98 is distributed via tubes 102 and through the reed valve inputs 20 of cylinders 16 to regions underneath the respective pistons 24 where supercharging chambers 76 are provided above conical members 30, the latter being shaped for directing the fuel-air mixture into a chamber. Each time a piston 24 moves in an upward direction, fuel-air mixture is drawn into the supercharging chamber through a reed valve 20. As the piston 24 moves downwardly, reed valve 20 closes while reed valve 22 opens allowing the fuel-air mixture in the supercharging chamber 26 to be forced into pressure tank 78 located at the outer periphery of the engine. There are several such pressure tanks, one associated with each cylinder. In the four-stroke engine according to the present invention, intake valve 70 opens to introduce the fuel-air mixture into combustion chamber 74 only for every other stroke of the piston, and consequently the mixture is twice compressed within pressure tank 78, with the degree of compression being dependent upon the size of the pressure tank. Suitably, the volume of the pressure tank is similar to that of supercharging chamber 76. Consequently about three supercharging chamber volumes are forced through pressure tank 78 for each firing stroke.

The exhaust manifold 104, like the outlets of pressure tank 78, is connected to appropriate valves through passages in head portions 82 secured to the respective cylinders. Thus, when an exhaust valve 71 is operated by a push rod 86, the spent gases will be forced into the exhaust manifold and coupled away from the engine.

The compression ratio of the pistons can be altered according to the present invention. As mentioned, the outer cylindrical portion 50 of cam drum 46 is joined to inner drum portion 48 by means of a splined connection 52. This splined connection allows relative vertical movement between portion 50 and portion 48. The portion 48 is fixed in vertical position between bearings 96, but the cylindrical portion 50 is mounted upon bearings 49 disposed at the upper end of annular piston 58 mounted in an annular cavity 60 in plate 12 whereby piston 58 is movable upwardly and downwardly for forcing cylindrical drum portion 50 upwardly or permitting the same to lower. The annular cavity 60 is coupled via a valve V to a source of hydraulic fluid and, under control of the valve, the piston 58 may be raised or lowered. It will be apparent that rising of the piston 58 simultaneously moves the various pistons 24 farther upwardly within the various cylinders 18 for increasing the compression ratio as desired. Although the upward and downward movement of the pistons 24 can be manually controlled with valve V, the valve V is suitably controlled automatically in accordance with engine speed or in accordance with acceleration as well as speed. Means for determining speed and acceleration are known in the art.

The splined connection 52 may comprise vertical splines, or alternatively the splines may be diagonal or helical, for example as illustrated in 130 in FIG. 3. Therefore, when the cylindrical portion 50 is raised relative to drum portion 48, the operation of the intake and exhaust valves is changed in timing relative to the reciprocation of the pistons, and the initiation of ignition is similarly changed by means (not shown) responsive to cam follower 62. For an upward movement of cylindrical portion 50 indicated by A in FIG. 3, the relative rotational positions of portions 50 and 48 will change by a dimension B in FIG. 3.

Figure 9:
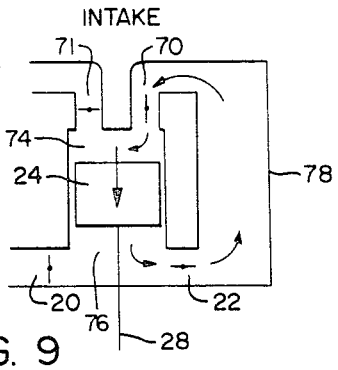
Figure 10:
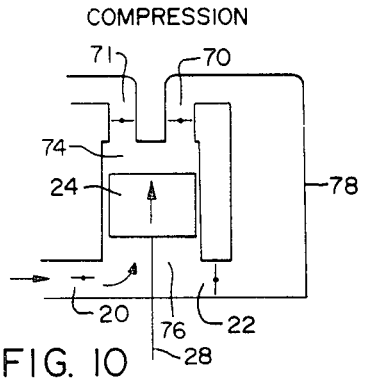

The respective firing, exhaust, intake and compression strokes together with the opening and closing of the various valves for a given cylinder are illustrated in FIGS. 7, 8, 9 and 10. During the firing stroke it is seen the exhaust and intake valves 71 and 70 are closed while the fuel-air mixture is ignited and piston 24 moves downwardly. The fuel-air mixture in supercharging chamber 76 is forced through open reed valve 22 into pressure tank 78. During the exhaust stroke as illustrated in FIG. 8, the piston 24 moves upwardly and exhaust gases are forced through valve 71. Meanwhile, fuel-air mixture is drawn through reed valve 20, while reed valve 22 is closed. During the intake stroke as depicted in FIG. 9, piston 24 moves downwardly and the fuel-air mixture in the supercharging chamber 76 is once more forced into pressure tank 78 such that three supercharging chamber volumes are in the pressure tank 78 (it being understood that two volumes would just equalize the pressure). The intake valve 70 is opened and receives the pressurized fuel-air mixture. During compression in FIG. 10, both valve 70 and 71 are closed so that the compression can take place, and reed valve 22 is closed such that a portion of fuel-air mixture is retained in pressure tank 78. Reed valve 20 is open so that additional fuel-air mixture is drawn into the supercharging chamber 76. The sequence then reverts to FIG. 7 for firing.

Figure 11:
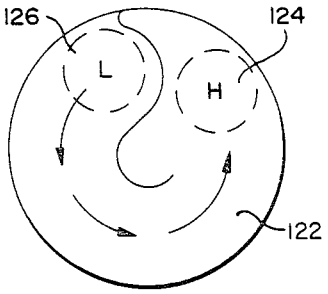
FIG. 11 is an end view of a piston employed according to an aspect of the present invention.
Figure 12:
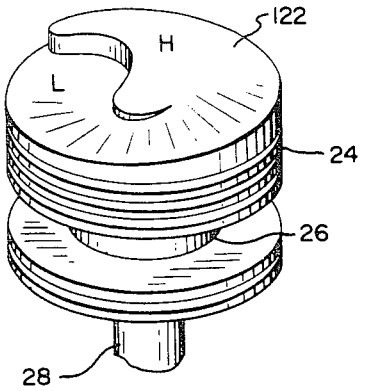
FIG. 12 is a perspective view of the FIG. 11 piston.
Figures 15, 16:
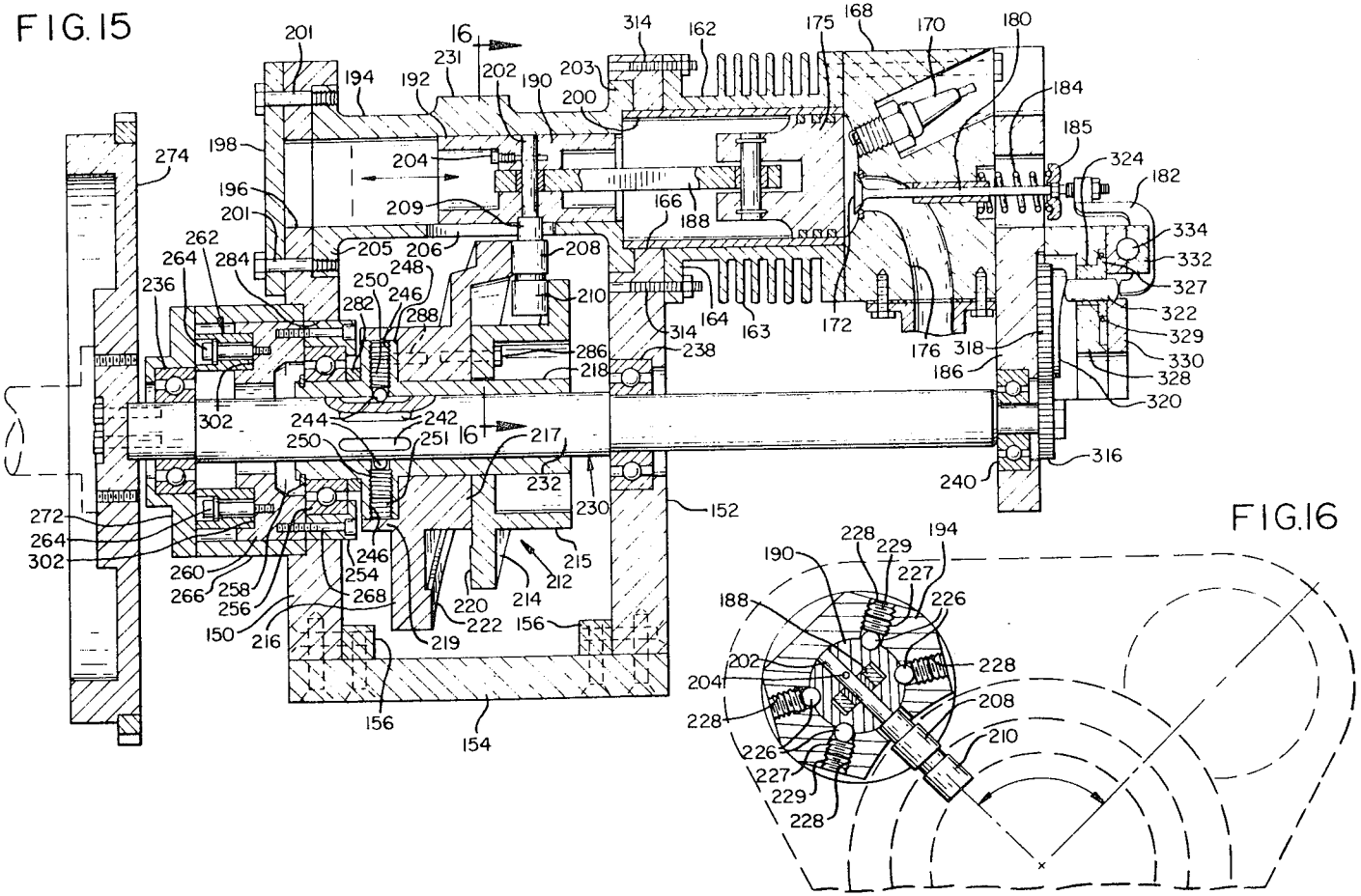
FIG. 15 is a longitudinal cross section of the FIG. 13 engine.
FIG. 16 is a partial transverse cross-sectional view taken at 16—16 in FIG. 15.

The end 122 of the piston 24 is depicted in FIGS. 11 and 12 and is suitably provided with a spiral or helical surface to provide swirling and agitation of the fuel-air mixture. The end of the piston has a low area 126 which is in juxtaposition with the intake valve, and a high area 124 in juxtaposition with the exhaust valve, with the surface ramping in spiral fashion therebetween to provide a desired swirling action. Spark plug 130 (FIGS. 1 and 2), for igniting the fuel-air mixture, is suitably placed adjacent the intake valve.

Another embodiment of my invention is illustrated in FIGS. 13 through 23. This four stroke engine employs two somewhat larger cylinders, each firing approximately every other revolution of the output shaft. The two pistons are positioned for exerting pressure against an output cam having a single lobe. The engine is suitable for lower speeds and higher power, but is nevertheless compact and light in weight.

Referring to the drawings and particularly FIGS. 13–23, the engine according to this embodiment comprises a frame 148 having a forward end plate 150 and a rear end plate 152, each extending upwardly from base plate 154 adjacent parallel corner blocks 156. Side braces 158 are secured between side edges of the somewhat trapezoidal-shaped end plates.

Rear end plate 152 mounts a pair of horizontally oriented cylinders 161 and 162 provided with cooling fins 163 and radial flanges 164 for securing the cylinders to end plate 152 in such manner that piston receiving sleeves 200 within the cylinders are positioned in matching apertures 166. Pistons 174 and 175 are respectively located within cylinders 161 and 162.

At their remote ends, each cylinder is provided with a cylinder head 168 mounting a spark plug 170, and intake and exhaust valves as will hereinafter be more fully discussed. One such valve, illustrated at 172 in FIG. 15, communicates between the combustion chamber above piston 174 and passage 176 in head 168 leading to an exhaust or intake manifold. The poppet valve is provided with a valve stem 180 operated by rocker arm 182 and is biased to the closed position by a valve spring 184 disposed between the head and retainer 185. The respective valve stems and springs are received through apertures in valve plate 186 which is supported between the heads 168 as secured to the respective cylinders 161, 162.

Each of the pistons 174, 175 is attached by means of a wrist pin to a connecting rod 188, the opposite end of which is pivotally connected to the central web 190 of a follower slide 192, the latter being substantially cylindrical externally and slidably received in cylindrical guide member 194. End flanges 203 and 205 of each guide member 194 are respectively received in a countersunk portion around aperture 166 in end plate 152 and a countersunk portion around the aligned aperture 196 in end plate 150. The rearward flange 203 of guide member 194 is counterbored to receive sleeve 200. A cap 198 closes the aperture 196 in plate 150 and is secured to the forward flange 205 of guide member 194 by means of bolts 201 extending through holes in plate 150. Bolts 314 secure flange 164 of the cylinder to plate 152.

Slide 192 has four longitudinal grooves 224 slidably receiving balls 226 positioned in wells 228 extending radially inwardly from central collar 231 of guide member 194. The balls are positioned by means of set screws 227 threadably received in the wells and locked by locking screws 229. This construction facilitates longitudinal movement of slide 192 without permitting turning movement thereof which would change the angle of pin 202 carried thereby.

Central web 190 of slide 192 carries the laterally extending pin 202 having a transverse aperture in one end for receiving the end of a locking pin 204 threadably engaging the web. The pin 202 extends transversely outwardly through side slot 206 in guide member 194 where the pin carries counter-rotating rollers 208 and 210 for bearing on output cam 212. Pin 202 also extends in bearing relation through connecting rod 188 such that the connecting rod is pivotally secured to the guide member 192.

The cam 212 includes an inner part 214 and an outer part 216 which extend respectively from drum portions 215 and 217, the drum portions being held in coaxial abutting relation with screws 286 and secured to hollow slide shaft 218 with screws 288. Slide shaft 218 is coaxial with main engine shaft 230, and the two are locked together for simultaneous rotation as hereinafter more fully explained. The inner cam portion 214 includes a forwardly facing cam surface 220 for engaging roller 210, while outer cam portion 216 includes a rearwardly facing cam surface 222 for engaging roller 208. Thus, cam surface 222 is disposed radially farther outwardly from the center of slide shaft 218 than is cam surface 220. Otherwise, however, the cam surfaces are substantially identical in profile and each is perpendicular throughout its extent to the axis of slide shaft 218, i.e. parallel to rollers 208 and 210 for engagement therewith. The spacing between the two cam surfaces is such as to just receive the rollers 208 and 210. Cam portion 216 receives most of the force of the power stroke from roller 208, and also moves the piston rearwardly (to the right in FIG. 15) during the compression and exhaust strokes. Cam portion 214 drives the piston forwardly (to the left in FIG. 15) for the intake stroke.

Slide shaft 218 is longitudinally slidable along main shaft 230, the latter having a first diameter at 232 for matingly receiving slide shaft 218, a smaller diameter portion at either end thereof rotatable in bearings 236 and 238 supported from end plates 150 and 152, and a third portion of yet smaller diameter rotatable in bearing 240 supported in valve plate 186. Portion 232 of shaft 230 has a plurality of longitudinal grooves 242 forming splines for slidably receiving balls 244 which are positioned in wells 246 of radial flange 248 comprising part of slide shaft 218. Set screws 250 are threadably received in the wells 246 for positioning the balls in sliding relationship with the grooves, and locking screws 251 are received above the set screws. This construction permits sliding movement between slide shaft 218 and main shaft 230 but locks the two shafts together for common rotation. Flange 248 is fastened to drum portion 217 with screws 288 such that the cam 212 is similarly constrained. An axial flange 219 of drum portion 217 is received over radial flange 248 of slide shaft 218.

A spacer ring 282 separates flange 248 of slide shaft 218 from a bearing 256 located forwardly along the slide shaft and rotationally supporting the slide shaft. A retaining ring 258 received in a groove on the slide shaft longitudinally positions the slide shaft in locking relation with bearing 256 such that axial movement of the bearing moves the slide shaft and cam 212 along main shaft 230. Bearing 256 is held between bearing cap 254, which is axially slidable in aperture 284 of end plate 150, and a cylindrical, cup-shaped bearing support 260 to which cap 254 is secured by means of screws 268. Bearing support 260 is apertured to receive the main shaft 230 therethrough, and is provided with a pair of ramp-shaped parallel slots on its forward or cupped end on either side of the central aperture. The ramp-shaped slots receive sides 306 of a wedge member 262 which is also centrally open so that shaft 230 can pass therethrough. The wedge member is in the form of a rectangular frame wherein the parallel sides 306 have the same angle of ramp as the slots, 302 in which the sides 306 are received. The wedge member 262 is transversely movable with respect to bearing support 260 whereby a variable spacing is produced between bearing 256 and the forward end of the engine. Thus, the cam 212 is controllably movable with respect to cylinder heads 168.

Referring particularly to FIG. 17, it will be seen that wedge member 262 is constrained to slide along cover plate 272 which is spaced from end plate 150 by rectangular frame 266 within which wedge member 262 is received. Cover 272 also supports forward end bearing 236 for main shaft 230. Sides 306 of wedge member 262 are provided with parallel slots 276 extending through sides 306 in a direction longitudinal of the engine, and the wedge member 262 is recessed at 278 to receive the enlarged heads of screws 264 which extend through slots 276 in the sides 306 for threadable engagement with bearing support 260 at the bottoms of slots 302 therein. The bottom of each recess 278 is spaced a fixed distance from the ramping interface between sides 306 of ramp member 262 and the bottoms of slots 302 in bearing support 260. The screws 264 do not tightly secure the wedge member 262 to bearing support 260, but rather the enlarged heads 265 of the screws are spaced from the bearing support to slidably engage the bottoms of recesses 278, the enlarged heads being larger in diameter than the width of respective slots 276. The screws 264 hold the support 260 in slidable contact with the wedge member 262, while the wedge member provides variable spacing between the support 260 and cover 272, depending on the lateral position of the wedge member. Consequently, lateral movement of wedge member 262 can urge bearing support 260 in a forward or rearward direction, causing the bearing 256 and the slide shaft 218 carrying cam 212 to be moved in a longitudinal direction. In particular, a threaded shaft 270 which threadably engages a fixed nut 308 is rotatable via an air motor 280. The opposite end of threaded shaft 270 is held in bearing 310 fixed to one end of wedge member 262. Consequently, clockwise and counterclockwise rotation of air motor 280 is effective to produce forward and rearward motion of cam 212 for bringing about a selectable compression ratio for engine cylinders 161, 162. The manner in which this adjustment is made is hereinafter more fully described.

Figures 20, 21, 22:
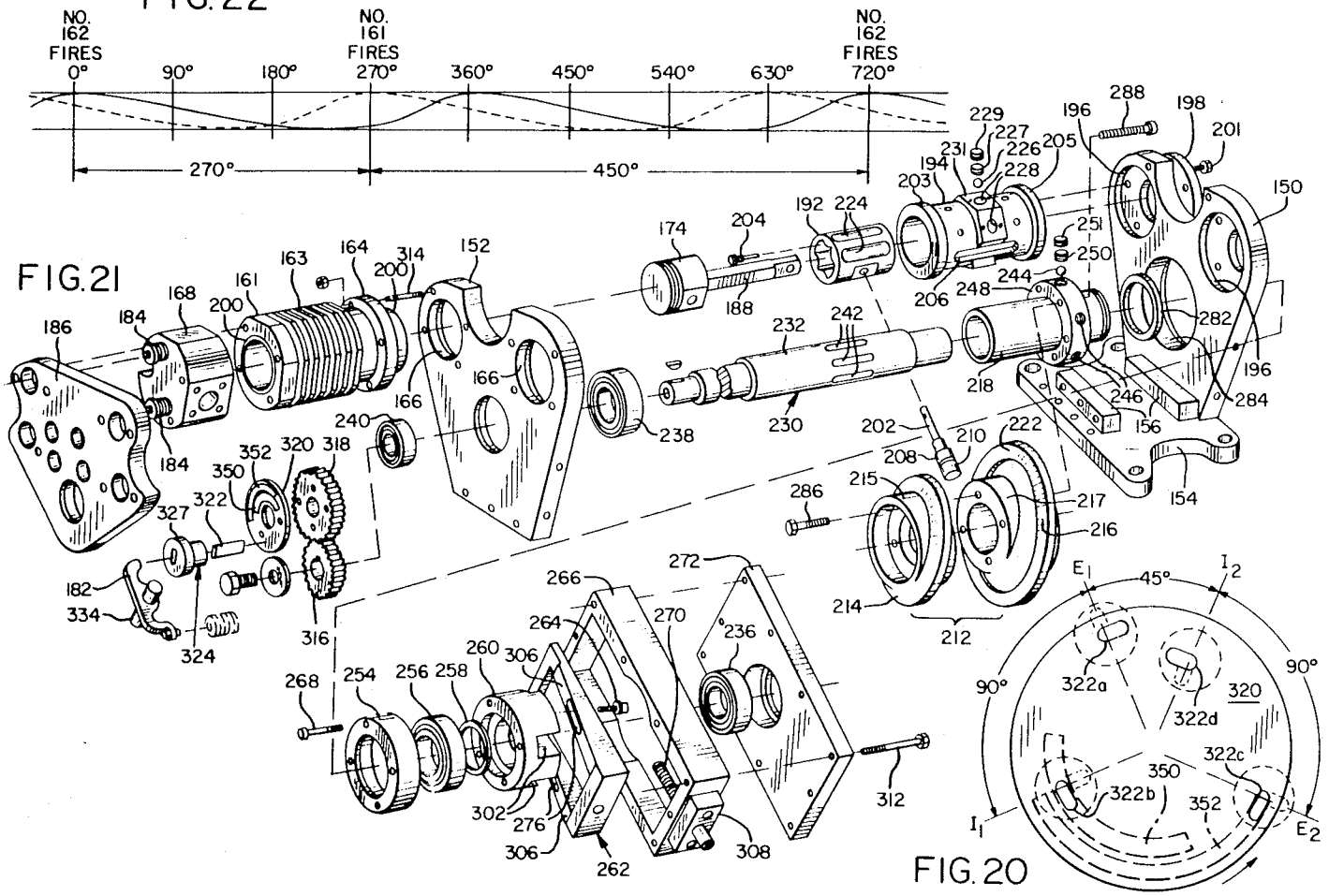
FIG. 20 is a diagrammatic view illustrating cam operation of the engine according to the second embodiment.
FIG. 21 is an exploded view of the engine according to the second embodiment.
FIG. 22 is a diagram illustrating cam profile and the cycle of movement of the pistons in the engine according to the second embodiment.

FIG. 22 illustrates the profile of the one-lobed cam 212 and also describes the cycle of movement of the pistons in cylinders 161 and 162. The dashed line illustrates operation of cylinder 161 and the solid line is indicative of operation of cylinder 162. It is seen the power stroke following firing, and the intake stroke starting 360° after firing, are longer in this embodiment than the intervening exhaust and compression strokes. However, the invention is not limited to this particular configuration.

Each of the cylinders fires every 360°. However, assuming counterclockwise rotation of the main shaft as viewed from the front or left of the engine in FIG. 13, cylinder 161 fires 270° after cylinder 162, and then 450° later cylinder 162 fires again. This asymmetry is a consequence of the spaced or asymmetric location of the cylinders. However, this embodiment provides slower output shaft rotation with the one-lobed cam, with each of the cylinders firing during every other revolution.

The valving of the engine will be further considered with respect to FIG. 14 wherein the positions of four valves are noted at the locations of valve spring retainers 185*a*, 185*b*, 185*c* and 185*d*. The valve positions are further designated $E_1$ and $I_1$ to indicate the exhaust and intake valves respectively for cylinder 161, and $E_2$ and $I_2$ to indicate exhaust and intake valves for cylinder 162. These valves are operated through intervening mechanism in response to rotation of main shaft 230, the rearwardmost end of which carries a gear 316 meshing with gear 318 having a rotating axis perpendicular to valve plate 186. The ratio of gear teeth on gear 318 to gear 316 is two to one whereby gear 318 turns one revolution for two revolutions of the main shaft. Secured to gear 318 is a valve cam plate 320, more fully illustrated in FIG. 18, provided with an intake cam raised track portion or segment 350 for operating valves designated $I_1$ and $I_2$ via intermediate rocker arms 182, and exhaust cam raised track portion or segment 352 for operating exhaust valves designated $E_1$ and $E_2$ via the intermediate rocker arms. Each of the raised track portions 350 and 352 comprises an arcuate segment around the center of valve cam plate 320, with segment 352 comprising an approximately 135° arc, while segment 350 comprises an approximately 120° arc, each starting from starting positions or most counterclockwise positions that are separated by 45° as shown. Cam followers 322 (see for example FIG. 15 or FIG. 21) are raised by the cam segments on cam plate 320 and selectively raise rocker arms 182 for operating the respective valves.

Referring to the explanatory diagram of FIG. 20, the positions of cam followers 322*a*, 322*b*, 322*c* and 322*d* for respectively operating cams designated $E_1$, $I_1$, $E_2$ and $I_2$ are illustrated. It will be seen that approximately 135° after cam segment 352 operates cam follower 322*c* for initially opening exhaust valve $E_2$ for cylinder 162, then cam segment 350 operates follower 322*d* to open intake valve $I_2$ for the same cylinder. Meanwhile, the exhaust valve $E_2$ will have closed since segment 352 will have substantially passed over its cam follower. Since the valve cam plate turns at half engine speed due to the ratio between gears 316 and 318, it will be seen the exhaust valve $E_2$ will be opened for 270° of engine rotation, after which intake valve $I_2$ will be opened. Intake valve $I_2$ will remain open for approximately 120° of rotation of valve cam plate 320, or for approximately 240° rotation of the engine main shaft. It is seen each of the valves begins its cycle every 360° of rotation of valve cam plate 320, or every 720° of rotation of the main shaft. After each intake, the compression stroke follows, and at the conclusion of compression, ignition is initiated by means not shown to bring about the power stroke.

Still referring to FIG. 20, at about the same time intake valve $I_2$ opens, exhaust valve $E_1$ for cylinder 161 is opened for 135°. Thereafter the intake valve $I_1$ for cylinder 161 will open. In terms of main shaft rotation of the engine, the spacing of valve operation between valves $I_2$ and $I_1$ is twice the 135° spacing around the cam plate, and similarly the spacing between operation of the exhaust valves for the two cylinders is twice the 135° spacing around the cam plate. Thus the cycle of operation for the two cylinders is displaced by 270° as was noted in connection with FIG. 22. With reference to FIG. 22, exhaust valve $E_2$ opens at the 90° point and exhaust valve $E_1$ opens 270° later, i.e. at the 360° point in the overall engine cycle. In each case the exhaust valves are open for 270° followed by opening of the corresponding intake valve.

Returning to FIG. 20, the spacing from the opening of exhaust valve $E_1$ around to the opening of exhaust valve $E_2$ in a counterclockwise direction is seen to be 225° (or 450° in terms of rotation of the main shaft). The spacing between the operation of intake valve $I_1$ and the subsequent opening of intake valve $I_2$ is also seen to be 225°. Thus, as noted, the cycle of operation is somewhat asymmetric.

Referring again to FIGS. 15 and 21, the cam followers 322 are somewhat flattened or oval-shaped in cross section and each slidably extends through a mating axial opening in a rotatable member 324. Each rotatable member 324 has a round shank rotatably received in an aperture in bracket 328, and a rearward radial flange 327 around which an operating cable 329 is entrained. As illustrated in FIG. 19, the cable 329 is entrained around each of the rotatable members 324*a*, 324*b*, 324*c* and 324*d* associated with the respective valves. The cable has secured thereto a plurality of small beads 331 which engage indentations in the edges of the rotatable member flanges whereby to rotate the rotatable members in unison. Since each carries one of the cam followers 322*a*, 322*b*, 322*c* or 322*d*, it is seen the orientation of the cam followers is simultaneously changed by movement of the cable.

The purpose for rotating the cam followers will be explained with reference to FIG. 20. It will be noted the cam followers 322 are rotatable between the full line position and the dashed line position, and are moved between the two positions through the instrumentality of cable 329. Cam followers 322*a* and 322*c* are located such that for their dashed line position, the cam segment 352 will operate the corresponding exhaust valves $E_1$ and $E_2$ for a period proportional to the length of cam segment 352. Similarly, for the dashed line position for cam followers 322*b* and 322*d*, the intake valves $I_1$ and $I_2$ will be open for a period of time proportional to the length of cam segment 350. Given time periods during which a valve is open are appropriate at lower engine speeds for an adequate fuel-air mixture to be inducted into a cylinder. However, at higher engine speeds shorter valve opening times occur, and an inadequate charge and lower compression can result. With the mechanism as illustrated in FIGS. 19 and 22, the valve opening times can be altered to produce the effect of a "longer cam" through rotation of the cam followers in a clockwise direction, i.e. from the dashed line position to the full line position. It will be seen the intake cam followers 322*b* and 322*d* in their full line positions are contacted by cam segment 350 at approximately the same points in the cycle of revolution as would be the case for their dashed line positions. However, the full line positions lengthen the cam opening periods since the cam followers will stay in contact with the cam segment longer, i.e. the cam followers will not "fall off" the cam segment immediately because the trailing portion of cam follower has been rotated into the circumferential path of the cam segment. The exhaust cam followers 322*a* and 322*c*, when rotated from the dashed line to the full line position, will be opened sooner by cam segment 352. Consequently, the intake valves can be opened longer and the exhaust valves opened sooner (and therefore longer) for more efficient operation at higher speeds. Of course, the cam followers are adjustable to any degree between the dashed line and full line positions to provide variation in valve opening periods. For the purpose of controlling the cam followers, cable 329 is frictionally engaged around control shaft 354 which can be manually rotated or rotated automatically in a clockwise direction in proportion to higher engine speeds.

Bracket 328 is secured to valve plate 186 in such manner as to provide clearance under bracket 328 for the cam plate 320 and cam followers 322. A matching bracket 330 is secured over bracket 328, with bracket 330 having apertures of sufficient diameter to receive cam followers 322 in any rotational position. Rocker arms 182 are rotatable on pins 334 received in mating grooves in bracket 330 while plate portions 332 secure the ends of pins 334 to the underlying bracket 330 and define slots along which the main bodies of rocker arms 182 are free to assume differing angular positions.

The engine is further provided with an intake manifold 336 communicating with the passages in heads 168 leading to intake valves, and an exhaust manifold 338 connected to similar passages for the exhaust valves. A flywheel 274 is secured to the forward end of main shaft 230 and is provided therearound with spur gear teeth engageable with a conventional starter 300. An output shaft or clutch is located forwardly of flywheel 274.

Further considering automatic adjustment of main engine cam 212 for changing engine compression, air motor 280 in FIG. 17 is operated in response to a speed sensor 282, for example for measuring engine r.p.m. and adjusting the position of cam 212 in response thereto. At higher engine speeds, e.g. at speeds higher than the most efficient operating speed of an engine, the compression of the conventional engine decreases because of the inability of the valves to deliver the desired fuel-air mixture. Sensor 282 is adjusted to operate motor 280 when the engine exceeds a predetermined threshold value higher than optimum speed, e.g. said threshold value being 3,000 r.p.m., for thereby causing wedge member 262 to move to the right as viewed in FIG. 17. Movement of wedge member 262 is desirably substantially proportional to engine speed for increasing the engine compression ratio whereby actual compression is maintained near an optimum preselected value. Then as the engine speed decreases, sensor 282 operates air motor 280 in the reverse direction for correspondingly decreasing the engine compression ratio. It will be appreciated the motor 280 can be other than of the air motor type and can, for example, comprise hydraulic means and/or a servomechanism for sliding wedge member 262 either via threaded shaft 270 or directly.

Figure 23:
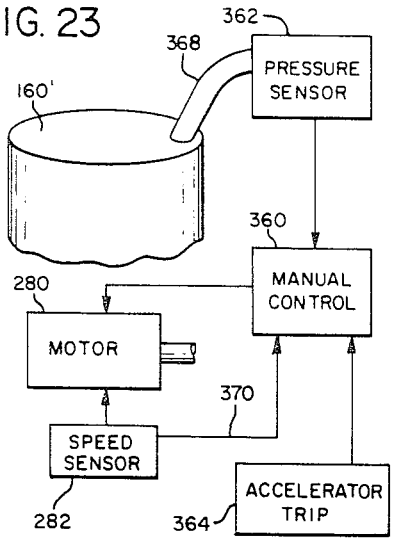
FIG. 23 is a diagram illustrating automatic control of compression ratio for engines according to the present invention.

Referring to FIG. 23, air motor 280 is also suitably operable at lower speeds by means of manual control 360, for example at times when the engine is essentially "cruising" or idling with comparatively low compression. Manual control 360 is overridden however by the output of a pressure sensor 362 communicating with the combustion chamber of cylinder 160' through tube 368. Tube 368 suitably extends through the cylinder head and communicates the pressure in the combustion chamber substantially instantaneously to sensor 362. When the pressure exceeds a predetermined excessive amount, sensor 362 overrides manual control 260 whereby motor 280 returns the engine compression ratio to normal for lower engine speeds. An accelerator trip 364 is also suitably employed for overriding manual control 360. Should the accelerator control, such as the accelerator pedal in a vehicle employing the present engine, be actuated for providing a substantial increase in fuel-air mixture via a carburetor (not shown), then trip 364 overrides manual control 360 and causes motor 280 to return the compression ratio to a normal value selected for slower engine speeds. Thus, engine compression is increased for engine speeds higher than a predetermined value, but manual control can be exercised at lower speeds subject to being overridden either by excessive pressure within the cylinder or by rapid acceleration. Thus, excessive cylinder pressures are avoided. Manual control 360 is understood to effect operation of motor 280 only for lower engine speeds, e.g. at speeds lower than the threshold value to which sensor 282 is operatively responsive, with manual control 360 being overridden at higher speeds as indicated at 370.

Referring to FIGS. 24–29, yet another embodiment of the present invention is depicted comprising an engine employing four cylinders and a single lobe output cam. This engine is somewhat similar in operation to the engine embodiment of FIGS. 13–23 in that it is adapted for lower speeds and higher power than the first described embodiment. However, the engine embodiment of FIGS. 24–29 has further advantages in regard to a more symmetrical or balanced operation. The four pistons of the embodiment of FIGS. 24–29 operate in pairs such that a cylinder fires and a power stroke is produced every 180° of main engine shaft rotation.

Referring to FIGS. 24–29, a frame 280 includes upper and lower plates 382, 384 separated by side members 386, 388. A forward end plate 390 and a rearward end plate 392 complete a box-like structure. The rearward end plate 392 supports a pair of cylinder blocks 394, 396, each of which is provided with a pair of bores receiving sleeves 398 within which the respective pistons slide. Block 394 receives pistons 401 and 402, while block 396 receives pistons 403 and 404. Cylinder heads 406 and 408 are positioned at the rearward ends of the cylinder blocks and provide separate combustion chambers for each cylinder. Separate spark plugs 410 and valves 412 are cooperate with each combustion chamber as hereinafter more fully discussed. The passages 413 through the side of the block communicate with valves 412 and are adapted to be connected to exhaust and intake manifolds.

Pistons 401, 402, 403, 404 are respectively secured to piston rods 421, 422, 423, 424 which extend in sealing relation through apertures in rearward end plate 392. On the opposite side of end plate 392, the piston rods are attached in pairs to slide blocks 426 and 428 having side, top and bottom surfaces parallel and slidable along the inside of respective side members 386, 388 and upper and lower plates 382, 384. Rods 421 and 422 are joined to slide block 426, while rods 423 and 424 are joined to slide block 428, whereby pistons 401, 402 execute identical strokes. Pistons 403, 404 are adapted to execute identical strokes 180° out of phase with pistons 401, 402.

Between slide blocks 426, 428 there is located an output cam 430 comprising an inner hub portion 432 slidable along main shaft 434 and an outer cylindrical portion 436 formed of a harder metal and secured to the hub portion. The cylindrical portion 436 has a cam groove 438, nearly semicircular in longitudinal cross section as viewed for example in FIG. 25, which extends completely around the outside of the cylindrical portion to describe a single lobe cam. In this groove are received comparatively large bearing balls 446 and 448 (having diameters of approximately three-fourth inch or greater depending on the size of the engine) which act as cam followers and which are held in bearing relation against slide blocks 426, 428. Each of the balls 446, 448 is held in a cup 450 having a cylindrical outer periphery or shell 452 received in a cylindrical bore in the side of a respective slide block. Within the cylindrical shell 452 is received a cylindrical block 454 having a spherical cup-shaped depression 458 at one end for locating a plurality of ball bearings 460 around the semi-periphery of one of the balls 446, 448 such that the ball is free to rotate in any direction. An apertured retaining plate 456 having a central aperture slightly smaller in diameter than the diameter of either ball 446, 448 is secured over the ball and against block 454 as well as shell 452 so as to capture the ball against the ball bearings 460. The cup 450 is adjusted by means of set screw 462, extending through the slide block so as to place the ball 446, 448 in bearing relation in the semicircular cross section of groove 438, the set screw 462 being locked in position by means of nut 464. The outward end of the set screw 462 as well as the nut 464 are received in a groove 466 in the side member 386, 388, and are accessible through an aperture 468 in the side member when the slide block 426, 428 is in a predetermined intermediate position between ends of piston strokes. The respective slide blocks 426, 428 are provided with concave surfaces 470 toward the cam 430 whereby to place the balls 446, 448 in adjoining relation to the cylindrical cam while locating the balls 446, 448 almost in a plane with connecting rods 421, 422 or connecting rods 423, 424 whereby the thrust of the pistons is placed on the balls 446, 448.

It is apparent that the thrust of the respective pistons urges the slide blocks 426, 428 in a direction for causing rotation of cam 430 and therefore rotation of the main shaft 444 to which the cam is slidably connected. The slide blocks are constrained by the inside of the frame and particularly by side members 386, 388 such that balls 446, 448 engage the cam groove 438 in the manner illustrated and the force from the pistons is transmitted in a direction for rotating the cam.

The main shaft 434 is supported between bearing 472 supported by cover plate 474 secured to end plate 390, and bearing 476 located in a central aperture 478 in end plate 392. Shaft 434 is centrally provided with a plurality of longitudinal grooves 480 forming splines for slidably receiving balls 482 positioned in wells 484 of hub 432. Set screws 486 are threadably received in the wells 484 for positioning the balls in sliding relationship with the grooves. Locking screws 488 are received above the set screws. This construction permits sliding movement between hub 432 and main shaft 434 but locks the two together for common rotation.

Hub portion 432 of cam 430 includes a radial end flange 489 and a reduced diameter forward neck 490 threaded at its forward end to receive a pair of threaded rings 492 in locking relation. Between rings 492 and flange 489 of the hub is disposed a first bearing ring 494 and a second bearing ring 496, the latter being located between ring 494 and hub 432. Ball bearings are disposed as illustrated between rings 494 and 496, and between ring 496 and hub 432.

Ring 496 extends radially outwardly somewhat farther than flange 489 where it is provided with a forwardly extending axial flange 498 having gear teeth 500 facing radially inwardly therefrom and an outer periphery that is threaded. The peripheral threads of flange 498 are matingly received in threaded aperture 502 of forward end plate 390. A gear motor 504 secured to cover plate 474 drives spur gear 506 via motor shaft 508 for the purpose of rotating ring 496. As a consequence of this rotation, the cam 430 will be moved axially relative to main shaft 434 for thereby changing the compression ratio of the engine. The compression ratio may be manually or automatically controlled as hereinbefore described in connection with the previous embodiment.

Main shaft 434 is provided at its rearward end with a bevel gear 510 for engaging a bevel gear 512 secured on a vertical shaft 520 supported between bearing members 516 and 518 attached to the rearward side of plate 392. A spur gear 522 is secured to the upper end of shaft 520 for meshing with spur gears 524 secured to cam shafts 526. Cam shafts 526 are located in vertical cavities in blocks 394 and 396 and each is provided with a plurality of cams 528 for contacting the stems of valves 412. The number of teeth on bevel gear 510 is half the number of teeth on bevel gear 512 whereby shaft 520 turns at half the speed of main shaft 434. Consequently, the respective exhaust and intake valves for each cylinder will be opened during a part of every other revolution of the main shaft, i.e. during the exhaust and intake strokes, while the valves will be closed during the compression and power strokes of each piston.

Figure 29:
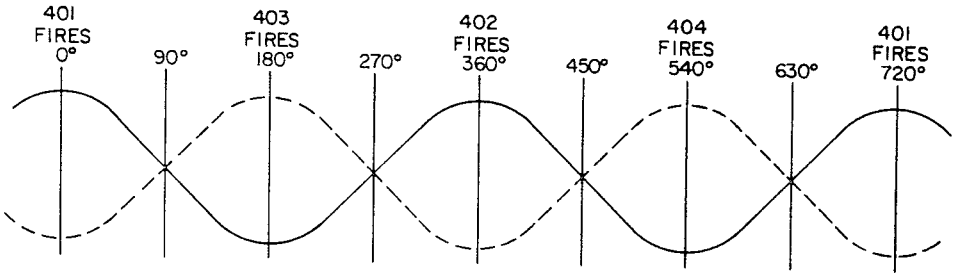
FIG. 29 is a diagram illustrating cam profile and the cycle of movement of pistons in the engine according to the third embodiment.
Figure 28:
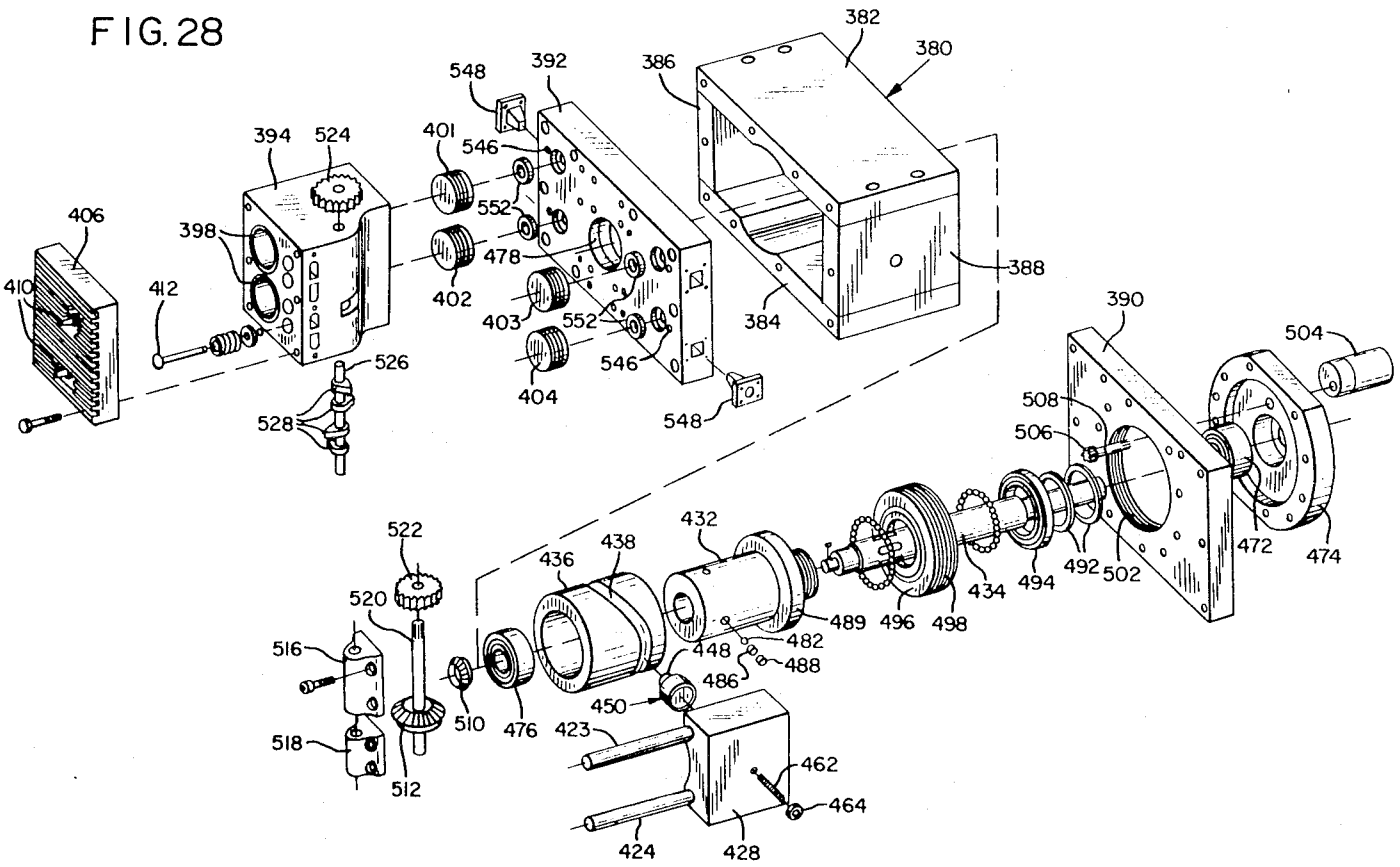
FIG. 28 is an exploded view of the FIG. 24 engine.

FIG. 29 illustrates the profile of the one-lobed cam 430 (i.e. of cam groove 438) and also describes the cycle of movement of pistons 401, 402, 403 and 404. The full line illustrates operation of pistons 401 and 402, while the dashed line illustrates operation of pistons 403 and 404. Considering the pair of pistons 401, 402 driving the common slide block 426, it will be seen that one of these two fires at every 360° revolution of the main shaft. Thus, piston 401 fires at 0°, piston 402 fires at 360°, piston 401 fires again at 720°, etc. Considering the pair of pistons 403, 404 driving slide block 428, it will be seen that piston 403 fires at 180°, piston 404 fires at 540°, etc. Thus, a piston on a first side of the cam fires at 0°, a piston on the opposite side of the cam fires at 180°, a piston on the first side of the cam fires again at 360°, and so on to provide balanced operation of the engine. The operation of the valves to coordinate the strokes described is believed apparent from the above and will not be described in detail.

The cylinder block bores are each provided with longitudinal grooves 540 which extend in a longitudinal direction approximately two-fifths of the length of the bore from plate 392 and which each extend in a circumferential direction about one-sixth of the way around the inside of the bore. Each slot 540 is long enough to communicate with ports or apertures 542 in the sleeve 398 disposed above the piston when the piston is in its rearward most position, farthest from the head end of the cylinder,and ports or apertures 544 located immediately adjacent plate 392. The slots 540, as well as the apertures 542 and 544 are symmetrically disposed around the respective cylinder block bores.

Passages 546 communicate to the cylinders underneath the pistons and extend to the peripheral exterior of plate 392 where the same are closed by reed valves 548. The reed valves operate such that outside air is inducted into the cylinder behind the piston each time the piston moves toward the head to execute a compression or exhaust stroke. Considering the exhaust stroke, air will be admitted through a passage 546 into the cylinder behind the piston, and this air will then be compressed behind the piston as the piston subsequently executes an intake stroke for drawing a fuel-air mixture into the head end of the cylinder. The valve 548 will be closed as the air behind the piston is compressed, and likewise seal 552 around the piston rod prevents escape of air. Near the end of the intake stroke, the pistons will expose ports or apertures 542 and allow the compressed air behind the piston to flow through apertures 544, slots 540 and apertures 542 into the area above the piston. This compressed air adds oxygen to the fuel-air mixture and has a supercharging effect. The additional air provides for additional burning, and additional turbulence of the fuel-air mixture, but leaves the richest fuel-air mixture adjacent the head end of the cylinder for firing. Air drawn into the cylinder through passage 546 during the compression stroke is also compressed in the power stroke and provided through apertures 542 at the end of the power stroke for further assisting combustion and assisting purging of the cylinder of combustion products.

Figure 24:
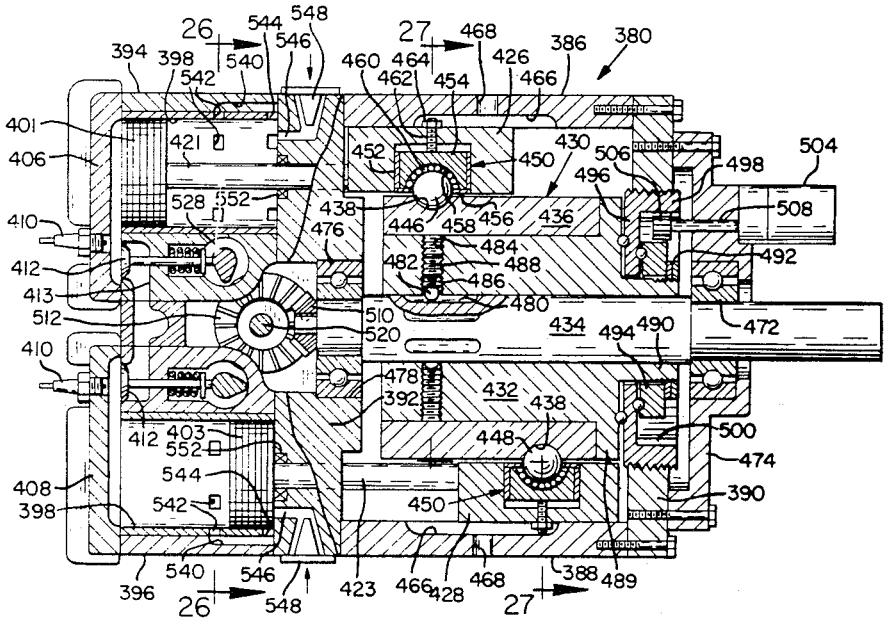
FIG. 24 is a horizontal cross-sectional view of an engine according to a third embodiment of the present invention.
Figure 25:
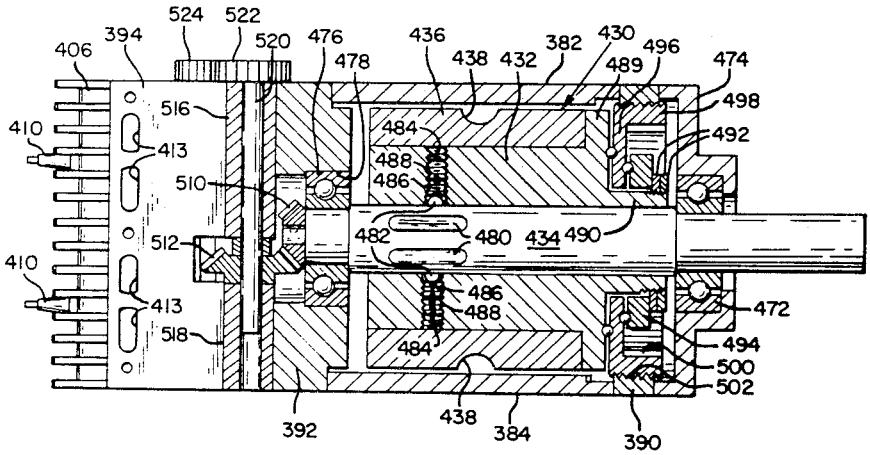
FIG. 25 is a vertical cross section of the FIG. 24 engine.
Figure 26:
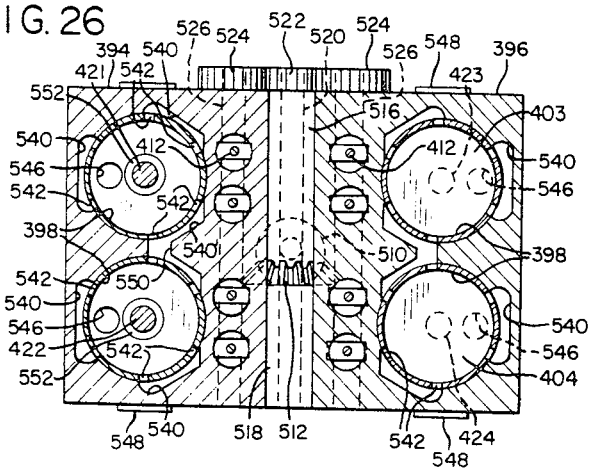
FIG. 26 is a transverse cross section of the FIG. 24 engine taken at 26—26 in FIG. 24.
Figure 27:
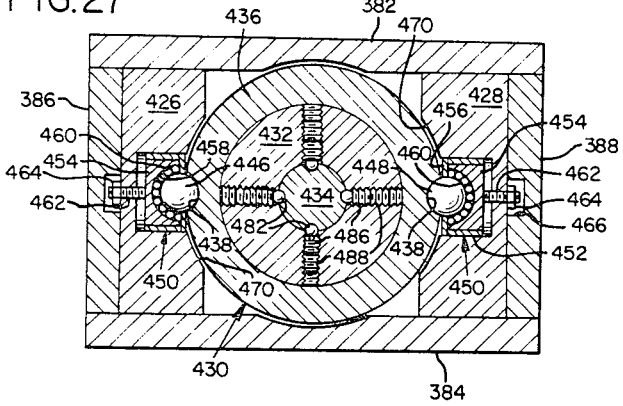
FIG. 27 is a transverse cross section through the FIG. 24 engine taken at 27—27 in FIG. 24.
Figure 30:
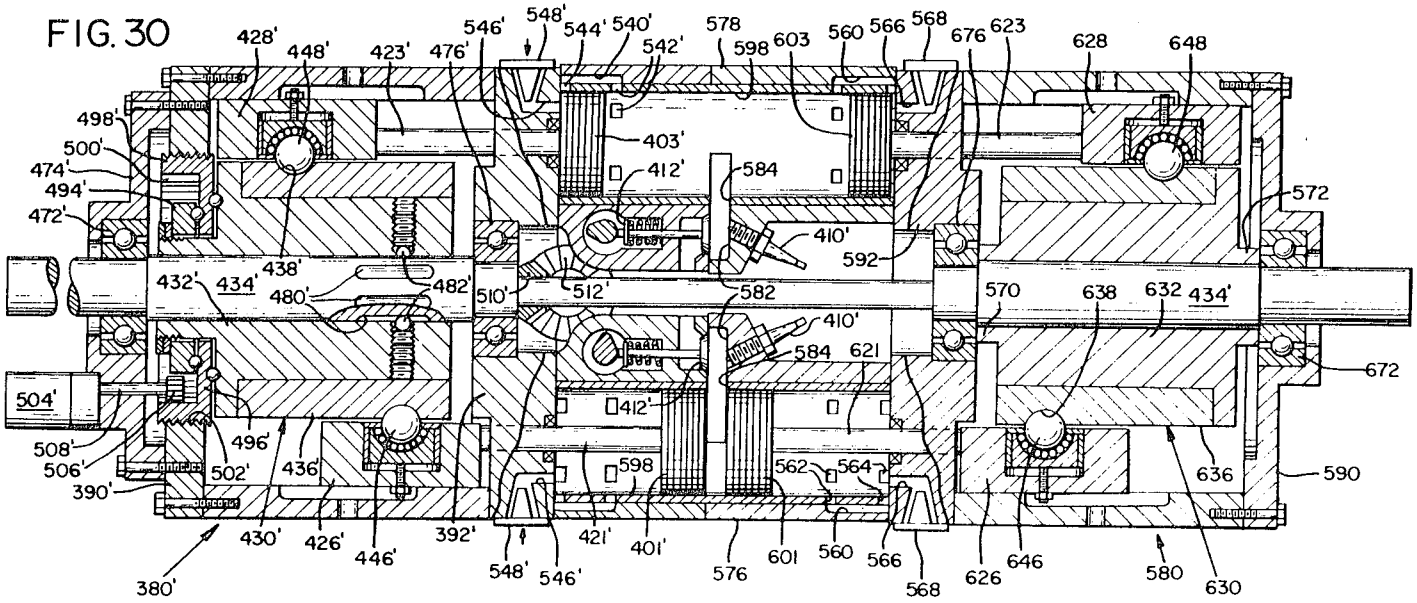
FIG. 30 is a horizontal cross section of an internal combustion engine according to a fourth embodiment of the present invention.
Figure 31:
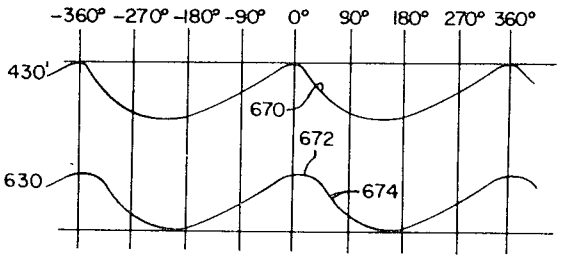
FIG. 31 is a diagram illustrating cam profile and the cycle of movement of pistons in the engine according to the fourth embodiment.

Another embodiment of the present invention is illustrated by FIGS. 30 and 31, and comprises an opposed-piston version of the last described embodiment. Viewing FIG. 30, it will be seen the left half of the engine is substantially identical to the engine as illustrated in FIG. 24, with primed reference numerals being employed to refer to similarly numbered components. The embodiment illustrated in FIG. 30 differs in that heads 406 and 408 of the previous embodiment are absent and elongated blocks 576 and 578 are substituted for housing elongated piston receiving sleeves 598. One sleeve 598 receives opposed pistons 401' and 601, while a second such sleeve receives opposed pistons 403' and 603. It will be understood that as in the previous embodiment the pistons are attached in pairs to slide blocks for engaging the output cam. Thus, piston 401' and a second piston (not shown) corresponding to piston 402 in the previous embodiment are attached via piston rods to a slide block 426' having side, top and bottom surfaces slidable along the inside of frame 380'. Also, piston 403' and a second piston (not shown) corresponding to piston 404 in the previous embodiment are attached to slide block 428' via piston rods. The structural arrangement is mirrored at the right-hand side of the engine depicted in FIG. 30 wherein piston 601 and a second piston of the corresponding pair (not shown) are attached to slide block 626, while a piston 603 and a second piston of the pair (not shown) are secured to slide block 628 through intermediate piston rods, for example rods 621 and 623.

The blocks 576 and 578 are provided with L-chambers 582 to which valves 412' communicate and receive spark plugs 410'. The L-chambers extend through partially circumferential slots 584 in sleeves 598. It will be appreciated one set of valves and one spark plug is common to each opposed pair of pistons. The spur gears for operating the valve cams are located on the far side or back of the structure according to the embodiment of FIG. 30.

A common shaft 434' extends longitudinally through the engine and receives a first output cam 430' in slidable relation thereto in the same manner as hereinbefore described with respect to cam 430 in the previous embodiment. The shaft 434' at the right-hand side of FIG. 30 also receives a second output cam 630 having a cylindrical portion 636 and a hub portion 632 provided with axial end flanges 570 and 572 adjacent main shaft bearings 672 and 676 such that cam 630 is not slidable with respect to the output shaft. Hub 632 is, however, keyed to shaft 434' for commcn rotational movement. It is understood that cam 630 could alternatively be constructed and arranged in the same manner as cam 430' for controllable sliding movement along the output shaft.

The cylindrical portion 636 of the output cam 630 has a cam groove 638 which is somewhat similar to cam groove 438' of output cam 430', but which is oriented such that pistons 401' and 601 close and open toward one another in opposed-piston relation. Similarly, pistons 403' and 603 operate in opposed piston relation as do the remaining aligned pairs of pistons of the engine.

The balls 646 and 648 are positioned by slide blocks 626 and 628 to engage the cam groove 638 in the manner illustrated, so that force from the pistons 601 and 603 can be transmitted in a direction for rotating the cam. The in-line opposed pistons (such as 401' and 601) operate in phase, e.g. have power strokes at approximately the same time. Movement of the balls 646 and 648 is in a direction for rotating cam 630 in the same rotational direction taken by cam 430' and both cams contribute to the output torque of shaft 434.

The right-hand side of the FIG. 30 engine is housed in frame 580 having end plates 590 and 592 respectively provided with bearings 672 and 676 in which the right-hand end of main shaft 434' turns. The cylinder block bores on the right-hand side of the engine are suitably provided with longitudinal grooves 560 which extend longitudinally in the manner of similar grooves 540 in the previous embodiment. Ports or apertures 562 and 564 are provided in sleeves 598 and function to provide a supercharging effect. Air is drawn through passage 566 from reed valve 568 when a piston moves toward the opposite piston, and air is then compressed behind the piston on the following stroke for expulsion through apertures or ports 562 when the piston reaches the outer end of the cylinder.

The profiles for the one-lobed cams 430' and 630 (i.e. cam grooves 438' and 638 respectively) are illustrated in FIG. 31. It should be understood the cam groove profiles are actually oriented such that the pistons close toward one another and open away from one another at approximately the same time. As may be seen from FIG. 31, the groove for cam 430' drops off rather rapidly from zero degrees dead center during a power stroke as illustrated at 670. The steepest part of the cam suitably makes an angle with the horizontal of approximately 45°. The correspondingly engaged piston, e.g. piston 401', will move rapidly away from the combustion chamber on the power stroke allowing optimum transmission of force to the cam. However, the groove of the opposite cam 630 initially moves much more slowly away from zero degrees dead center as illustrated at 672 and does not start dropping away rapidly until several degrees later as illustrated at 674. It will be observed, however, the remainder of the cam profiles are such that when the pistons are moving toward one another their movement will be approximately similar. Thus, the two pistons move toward one another for highly compressing the fuel-air mixture, with the right-hand piston such as piston 601 accomplishing a supercharging effect. Then at the start of the power stroke, piston 401', for example, is effective for transmitting power at an optimized cam angle, while the opposed piston 601 temporarily holds the compression to avoid outrunning of the explosion by the pistons. This type of operation is advantageous for confining the combustion mixture at the start of the power stroke and not allowing too rapid an expansion during combustion while providing a supercharging-like action.

Figure 32:
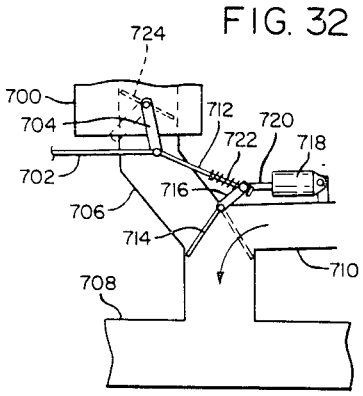
FIG. 32 is a diagram illustrating an intake device suitably employed with engines according to the present invention.

Referring to FIG. 32, an additional device is illustrated which is useful with the various engine embodiments according to the present invention. The purpose of this device is to prevent unduly "dirty" operation of an engine while decelerating. When decelerating, the carburetor butterfly valve of the conventional carburetor is moved toward the closed position, but nevertheless the vacuum produced by the engine exerts a considerable vacuum effect on the carburetor, and draws an incorrect fuel-air mixture into the engine. It is desired to correct this situation by drawing outside air into the engine during deceleration for speeds above the idling speed of the engine.

In FIG. 32, conventional carburetor 700, having a butterfly valve 724 operated from lever arm 704, supplies fuel-air mixture to intake manifold 708 via passage 706. Accelerator linkage 702 is pivotally attached to lever arm 704. An additional linkage 712, also pivotally attached to lever arm 704, has a sliding connection with lever arm 716 for rotating valve 714 in passage 706. Linkage 712 passes through a hole in the upper end of lever arm 716, and has an abutment or stop at its terminal end such that movement of the accelerator linkage 702 to the left in FIG. 32 will rotate lever arm 716 in a counterclockwise direction to open valve 714. Thus, when the carburetor is operated by accelerator linkage 702, the passage 706 will be open and allow the fuel-air mixture to pass into the intake manifold. Movement of the accelerator linkage 702 to the right in FIG. 32, as when decelerating, will normally move lever arm 716 in a clockwise direction for closing valve 714 since spring 722, attached at its upper end to the shaft of linkage 712, will urge the lever arm 716 to the right. As the valve 714 closes off the passage 706, air duct 710 is opened and allows the passage of outside air into the intake manifold 708.

As a consequence of the above action, the induction of an incorrect fuel-air mixture into the intake manifold during deceleration, i.e. during an engine throttled-down condition, is avoided, and instead outside air will pass into the cylinders. Therefore, the operation of the engine is cleaner during deceleration than in the case of a conventional engine.

For idling condition, however, it is necessary that a fuel-air mixture be inducted into the intake manifold even though the accelerator linkage is in the throttled-down condition. An electrically operated solenoid 718 having an armature or plunger 720 is pivotally connected to the upper end of lever arm 716. The plunger 720 normally slides back and forth within solenoid device 718, except when the solenoid is electrically operated, via means not shown for detecting low engine speed. Thus, a speed sensor is suitably employed to detect engine idling speed, in which case plunger 720 is operated to move to the left in FIG. 32 against the bias of spring 722 for moving valve 714 to the right toward the dashed line position. At this time, the fuel-air mixture will pass into the intake manifold.

The optimized cam angle for the power stroke in the engines according to the present invention is 45°, with the range of 35° to 55° being acceptable.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. In a four-stroke internal combustion engine, a plurality of cylinders each having a piston slidably received therewithin to define a combustion chamber and provided with means for selectively communicating a fuel-air mixture to said combustion chamber and communicating exhaust gases from said combustion chamber;

rotating cam means comprising a cylindrical outer drum provided with a circumferential cam surface mounted for coaxial rotation with a power delivery shaft by which power output of said engine is supplied;

an inner drum mounted on said power delivery shaft;

connecting rods extending from said pistons and provided with cam followers for engaging said cam means, wherein said pistons fire in predetermined order for rotating said cam means in response to pressure from said connecting rods;

an axially adjustable connection between said outer drum and said inner drum mounted on said power delivery shaft for varying a clearance between each said piston and a head of a corresponding one of said plurality of cylinders within which the piston is received, said axially adjustable connection comprising a splined connection between said outer drum and said inner drum; and control means for varying an axial position of said outer drum in relation to said inner drum while said engine is operating, said splined connection being helical in configuration for changing the time intervals for communicating said fuel-air mixture and communicating said exhaust gases relative to the position of each piston within each cylinder as said cam means is moved axially of said power delivery shaft.

2. In a four-stroke internal combustion engine, a plurality of cylinders each having a piston slidably received therewithin to define a combustion chamber and provided with means for selectively communicating a fuel-air mixture to said combustion chamber and communicating exhaust gases from said combustion chamber;

rotating cam means comprising a cylindrical outer drum provided with a circumferential cam surface mounted for coaxial rotation with a power delivery shaft by which power output of said engine is supplied;

an inner drum mounted on said power delivery shaft;

connecting rods extending from said pistons and provided with cam followers for engaging said cam means, wherein said pistons fire in predetermined order for rotating said cam means in response to pressure from said connecting rods;

an axially adjustable connection between said outer drum and said inner drum mounted on said power delivery shaft for varying a clearance between each said piston and a head of a corresponding one of said plurality of cylinders within which the piston is received;

said axially adjustable connection comprising a splined connection between said outer drum and said inner drum;

control means for varying an axial position of said outer drum in relation to said inner drum while said engine is operating;

means for sensing engine speed, said control means being responsive to said sensing means to adjust said axially adjustable connection to decrease the clearance between each said piston and the head of the corresponding one of the plurality of cylinders in response to engine operation at predetermined higher speeds;

manual control means for adjusting said axially adjustable connection to decrease the clearance between each said piston and the head of the corresponding one of said plurality of cylinders in response to said manual control means at speeds below said predetermined higher speeds; and means for overriding said manual control means in response to predetermined acceleration and cylinder pressure conditions.

3. In a four-stroke internal combustion engine, an array of cylinders each having a piston slidably received therewithin to define a combustion chamber and provided with means for selectively communicating a fuel-air mixture to said combustion chamber and communicating exhaust gases from said combustion chamber;

rotating cam means mounted substantially centrally of said array of cylinders, said rotating cam means having a driving relation to a power delivery shaft by means of which power output of said engine is supplied;

connecting rods extending from said pistons, said connecting rods being provided with cam followers for engaging different portions of said cam means, wherein said pistons fire in predetermined order for rotating said cam means in response to pressure on said connecting rods;

an axially adjustable splined connection between said rotating cam means and said power deliver shaft for varying the clearance between each said piston and a head of a corresponding one of said plurality of cylinders within which the piston is received;

control means for providing axial adjustment of said connection during operation of said engine, said control means including a bearing member for said rotating cam means;

laterally movable ramp means for positioning said bearing member; and motor means for moving said ramp means laterally to position said bearing member and said rotating cam means at a desired longitudinal location.

4. In a four-stroke internal combustion engine, a plurality of cylinders each having a piston slidably received therewithin to define a combustion chamber and provided with means for selectively communicating a fuel-air mixture to said combustion chamber and communicating exhaust gases from said combustion chamber;

rotating cam means mounted for coaxial rotation with a power delivery shaft by which power output of said engine is supplied;

connecting rods extending from said pistons and provided with cam followers for engaging said cam means, wherein said pistons fire in predetermined order for rotating said cam means in response to pressure from said connecting rods;

engine speed sensing means to move said cam means axially and thereby decrease a clearance between each said piston and a head of a corresponding one of the plurality of cylinders within which the piston is received in response to engine operation at predetermined higher speeds;

manual control means wherein said axially moving means decreases the clearance between each said piston and the head of the corresponding one of the plurality of cylinders within which the piston is received in response to said manual control means at speeds below said predetermined higher speeds; and means for overriding said manual control means in response to predetermined acceleration and cylinder pressure conditions.

* * * * *